US005666896A

United States Patent [19]

Vornholt et al.

[11] Patent Number: 5,666,896

[45] Date of Patent: Sep. 16, 1997

[54] NEEDLE, PARTICULARLY FOR EMBROIDERY MACHINES

[75] Inventors: Harry Vornholt, Bitz; Thomas Schmid, Balingen, both of Germany

[73] Assignee: Theodor Groz & Söhne & Ernst Beckert Nadelfabrik Commandit-Gesellschaft, Albstadt, Germany

[21] Appl. No.: 592,630

[22] Filed: Jan. 26, 1996

[30] Foreign Application Priority Data

Feb. 1, 1995 [DE] Germany ..... 195-03-048.6

[51] Int. Cl.[6] ..... D05B 85/00

[52] U.S. Cl. ..... 112/222

[58] Field of Search ..... 112/83, 98, 222, 112/226

[56] References Cited

U.S. PATENT DOCUMENTS

| | | | |
|---|---|---|---|
| 2,619,059 | 11/1952 | Rosenfeld | 112/222 |
| 3,624,675 | 11/1971 | Foster . | |
| 3,862,611 | 1/1975 | Kuromegawa | 112/222 |
| 4,423,837 | 1/1984 | Clements | 112/222 X |

FOREIGN PATENT DOCUMENTS

| | | | |
|---|---|---|---|
| 222055 | 5/1987 | European Pat. Off. | 112/222 |
| 2127737 | 10/1972 | France . | |
| 1485382 | 9/1969 | Germany | 112/222 |
| 1 239 556 | 7/1971 | Germany . | |
| 43 20 956 | 1/1995 | Germany . | |

*Primary Examiner*—Ismael Izaguirre
*Attorney, Agent, or Firm*—Spencer & Frank

[57] ABSTRACT

A needle includes a shank and a blade adjoining the shank. The blade has a conical length portion tapering in a direction away from the shank, a cylindrical length portion adjoining the conical length portion and a pointed tapering end portion adjoining the cylindrical length portion. The conical length portion is situated between the shank and the cylindrical length portion. An eye and a longitudinally extending groove are provided in the blade. Further, a circumferential, rounded constriction is provided in the blade adjacent the shank. The constriction which forms a predetermined breaking location, adjoins the conical length portion and is located between the shank and the conical length portion.

7 Claims, 1 Drawing Sheet

NEEDLE, PARTICULARLY FOR EMBROIDERY MACHINES

CROSS REFERENCE TO RELATED APPLICATION

This application claims the priority of German Application No. 195 03 048.6 filed Feb. 1, 1995, which is incorporated herein by reference.

BACKGROUND OF THE INVENTION

This invention relates to a needle, particularly for industrial embroidery machines and is of the type which has a shank and a blade adjoining the shank. The blade terminates in a tapered portion (cone) ending in a point and has at least one groove and an eye. The blade is provided, in the vicinity of the shank, with a weakened portion defining a predetermined breaking location.

Industrial embroidery machines, such as Schiffli machines and automatic multihead embroidery machines may have a length of approximately 19 m and may be provided with up to 1418 needles. In case a needle is bent or breaks, the embroidery pattern shifts or is severely damaged. In any event, the machine has to be stopped for replacing the needle. Also, the damage is substantial because a corresponding strip of the embroidery base has to be excised over the entire width of up to 19 m.

To avoid an elastic deformation (bending) of the needles during the embroidery process, frequently needles are selected which have a thickness greater than that which the embroidery base can tolerate. This leads to tears in the fabric or the thread. Also, the needles have to be relatively brittle as the result of the hardening process. This, however, increases the risks of needle breakage. While needle breakage is essentially highly undesirable, when it occurs, it should take place in the vicinity of the shank to ensure that the remaining needle stump cannot penetrate into the embroidery base and thus damage the base or the already-produced embroidery patterns.

Also it is desirable that the needle breaks before it is permanently deformed.

As disclosed in German Offenlegungsschrift (application published without examination) 4,320,956, it is known to provide machine needles with a predetermined breaking location formed as a groove or notches or slender bore holes which are provided in the cone below the shank and which may also be present in the region of the blade. Such grooves provided by material removal or notches and slender bores provided by laser beam processes, as well as the tendency of crack-formation in these structures, however, reduce the breakage resistance and thus the service life of the needle to an undesired extent. Consequently, such needles may be used only under restricted conditions.

SUMMARY OF THE INVENTION

It is an object of the invention to provide a needle, particularly for industrial embroidery machines (Schiffli machines and the like) which is substantially resistant to lateral loads, and, in case of overloading, a breakage in the vicinity of the shank is ensured at a predetermined location.

This object and others to become apparent as the specification progresses, are accomplished by the invention, according to which, briefly stated, the needle includes a shank and a blade adjoining the shank. The blade has a conical length portion (cone) tapering in a direction away from the shank, a cylindrical length portion adjoining the conical length portion and a pointed tapering end portion adjoining the cylindrical length portion. The conical length portion is situated between the shank and the cylindrical length portion. An eye and a longitudinally extending groove are provided in the blade. Further, a circumferential, rounded constriction is provided in the blade adjacent the shank. The constriction which forms a predetermined breaking location, adjoins the conical length portion and is located between the shank and the conical length portion.

It has been found in practice that the constriction according to the invention, in cooperation with the adjoining conical blade portion does not cause a loss of stability of the needle. Tests have shown that the load absorbing capacity of the needle for lateral loads up to needle breakage reaches at least the same magnitude as in a comparable conventional needle in which the cone adjoins immediately the shank, followed by the blade, as it is the case, for example, in the needle according to DIN (German Industrial Standard) 5330. In fact, the breaking force in the needle according to the invention may have a value of up to 150% of the corresponding value in the conventional needle. Upon excessive load, the needle according to the invention breaks at the predetermined location immediately at the end of the shank.

At its bottom the constriction may advantageously have a diameter which is approximately identical to the diameter of the cylindrical blade portion; it may be, however, greater or less than such a value. In the bottom zone the constriction is rounded and has a substantially circular arcuate course extending in a direction parallel to the needle length. The constriction expediently has a generally V-shaped outline as viewed in longitudinal section and is rounded at its transition to the shank and/or to the conical blade portion. The conical blade portion has a relatively slight conicity; the cone angle is preferably between approximately 0.5° and 2°. The length of the conical blade portion depends from the needle construction and is frequently between 10% and 50% of the entire blade length.

DESCRIPTION OF THE PREFERRED EMBODIMENT

Figure 1:
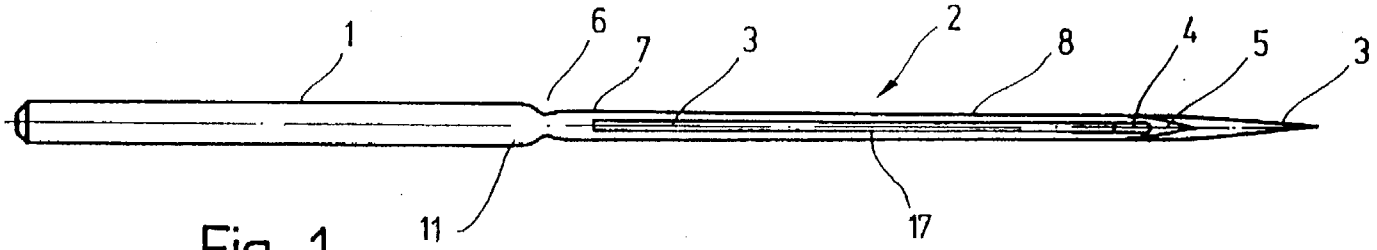
FIG. 1 is a top plan view of a needle according to a preferred embodiment of the invention.

The needle illustrated in the drawing is intended for use particularly in industrial embroidery machines (Schiffli machines), but may find application in other embroidery machines, sewing machines or the like. The needle is made of steel and has an essentially cylindrical shank 1 which may be unilaterally flattened and which is adjoined by a blade 2 terminating in a tapered, pointed end portion 3. In the blade 2 an axially parallel, long groove 3 is formed which leads to an eye 4 that is adjoined by a groove 5 located in the pointed end portion 3.

Immediately at the end of the shank 1, in the transitional portion to the adjoining blade 2, a circumferential rounded constriction 6 is provided, for example, by hammering the needle parison during manufacture. The constriction 6 is adjoined, at its side oriented away from the shank 1, by a conical blade portion (cone) 7 which tapers towards the pointed end portion 1 and which, at location 17 changes into a cylindrical blade portion 8 extending to the eye 4. The blade of the needle structured according to the invention may be conventionally thickened in the zone of the eye 4 or the blade thickness may be reduced, for example, in the cylindrical region 8.

Figure 2:
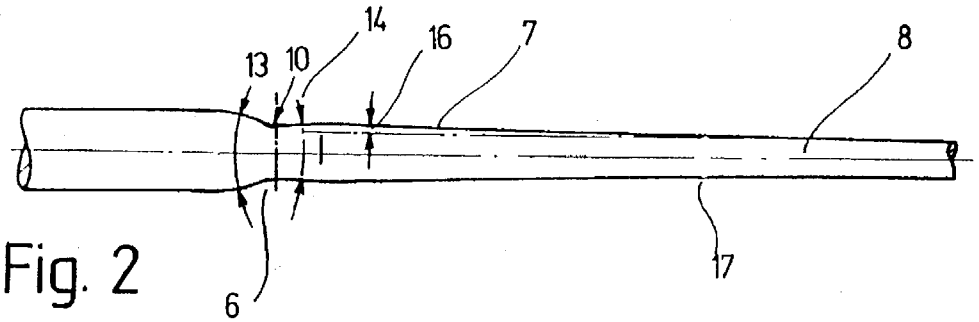
FIG. 2 is a fragmentary top plan view of the preferred embodiment, on an enlarged scale relative to FIG. 1.
Figure 3:
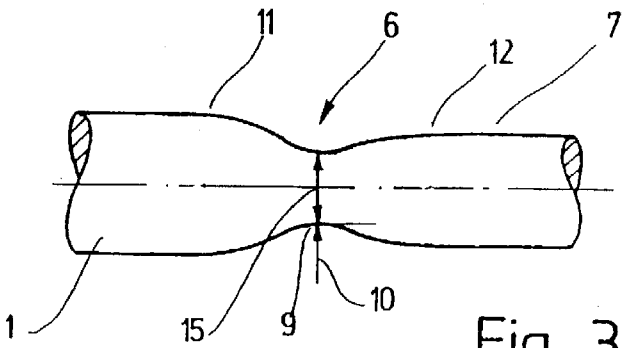
FIG. 3 is a fragmentary top plan view of the preferred embodiment, on an enlarged scale relative to FIG. 2.

The constriction 6 has, as it may be particularly well observed in FIG. 3, an essentially V-shaped outline as viewed in side elevation (or in longitudinal section), while the bottom zone 9 is of circularly arcuate configuration having a radius designated at 10. At its outer edge the constriction 6 is rounded so that at locations 11 and 12 smooth transitional zones to the shank 1 and to the conical region 7 are obtained. The angle which the two conical walls of the constriction 6, extending from the bottom zone 9, form with one another is on either side of the bottom zone 9 designated at 13 and 14 in FIG. 2. The angle 13 on the shank side is approximately 20° to 30°, preferably approximately 25°, whereas the angle 14 adjoining the conical zone 7 is between approximately 10° and 15°.

The diameter of the constriction 6 at the bottom 9 is approximately identical to the diameter of the cylindrical blade portion 8 and is designated at 15 in FIG. 3. The cone angle of the conical blade portion 7 is approximately 0.5°–2° and is designated at 16 in FIG. 2. The length of the conical length portion 7 which extends approximately to the location 17 shown in FIGS. 1 and 2, is approximately between 10%–50%, perferably approximately 30% of the entire length of the blade measured from the end of the shank 1 at location 11 (where transition to the constriction 6 starts) to the end of the pointed length portion 3.

The constriction 6 forms a predetermined breaking point in the immediate vicinity of the shank 1. The constriction 6, as it cooperates with the adjoining conical portion 7 does not, however, lead to any stability loss of the needle as compared to conventional needles. Rather, an increase in the resistance of the needle against lateral loads is achieved and the needle excels in an overall high long-period breakage-resistance.

It will be understood that the above description of the present invention is susceptible to various modifications, changes and adaptions, and the same are intended to be comprehended within the meaning and range of equivalents of the adapted claims.

What is claimed is:

1. A needle comprising (a) a shank (b) a blade adjoining said shank; said blade including (1) a conical length portion tapering in an direction away from said shank; and (2) a cylindrical length portion adjoining said conical length portion; said conical length portion being situated between said shank and said cylindrical length portion;

(c) a pointed tapering end portion adjoining said cylindrical length portion;

(d) an eye provided in said blade;

(e) a longitudinally extending groove provided in said blade; and (f) a circumferential, rounded constriction provided in said blade adjacent said shank; said constriction being located between said shank and said conical length portion and adjoining said conical length portion; the constriction constituting a predetermined breaking location.

2. The needle as defined in claim 1, wherein said constriction includes a bottom having a diameter approximately equalling the diameter of said cylindrical length portion.

3. The needle as defined in claim 1, wherein said needle has a length dimension; and further wherein said constriction includes a bottom having a substantially circulary arcuate outline as viewed in section taken parallel to said length dimension.

4. The needle as defined in claim 1, wherein said needle has a length dimension; and further wherein said constriction has a generally V-shaped outline as viewed in section taken parallel to said length dimension; said constriction having a rounded transition to said shank.

5. The needle as defined in claim 1, wherein said needle has a length dimension; and further wherein said constriction has a generally V-shaped outline as viewed in section taken parallel to said length dimension; said constriction having a rounded transition to said conical length portion.

6. The needle as defined in claim 1, wherein the cone angle of said conical portion is between approximately 0.5° and 2°.

7. The needle as defined in claim 1, wherein said conical length portion has a length which is between 10% and 50% of the length of said blade.

* * * * *

UNITED STATES PATENT AND TRADEMARK OFFICE

CERTIFICATE OF CORRECTION

PATENT NO. : 5,666,896
DATED : September 16, 1997
INVENTOR(S) : Harry Vornholt et al It is certified that error appears in the above-indentified patent and that said Letters Patent is hereby corrected as shown below:

On the title page, item [73], the name of the assignee should read --Groz-Beckert Kommanditgesellschaft--.

Signed and Sealed this

Seventeenth Day of March, 1998

Bruce Lehman

*Attest:*

BRUCE LEHMAN

*Attesting Officer*

*Commissioner of Patents and Trademarks*